US005176808A

United States Patent [19]

Byler et al.

[11] Patent Number: 5,176,808

[45] Date of Patent: Jan. 5, 1993

[54] HIGH CURRENT DENSITY CONTINUOUS WIRE PLATING CELL

[75] Inventors: Tom E. Byler, Pittsfield; Robert S. Orbanic, Warren; Kimberly J. Suchar, Waterford, all of Pa.

[73] Assignee: GTE Products Corporation, Stamford, Conn.

[21] Appl. No.: 431,798

[22] Filed: Nov. 6, 1989

[51] Int. Cl.[5] ..... C25D 7/06; C25D 17/00

[52] U.S. Cl. ..... 204/206; 204/239; 204/275; 204/279; 204/284; 204/292

[58] Field of Search ..... 204/28, 206-211, 204/239, 275, 279, 284, 292

[56] References Cited

U.S. PATENT DOCUMENTS

| | | | |
|---|---|---|---|
| 3,549,507 | 12/1970 | Semienko et al. | 204/208 |
| 3,894,924 | 7/1975 | Toledo | 204/28 |
| 3,994,786 | 11/1976 | Marks et al. | 204/28 |
| 4,769,114 | 9/1988 | Podrini | 204/206 |

OTHER PUBLICATIONS

Avila et al., "Methods of and Apparatus for Treating Articles", U.S. Def. Publication No. 667,231, Nov. 18, 1969.

*Primary Examiner*—Donald R. Valentine
*Assistant Examiner*—David G. Ryser
*Attorney, Agent, or Firm*—Elizabeth A. Levy

[57] ABSTRACT

A wire plating cell comprises an enclosed housing into which plating solution is pumped at a high velocity so as to create substantial fluid pressure therein. The plating cell contains a plurality of consumable anodes through which a wire passes axially and through which plating solution flows transversely. Current densities of at least 200 amps per square foot are obtained. Use of a highly concentrated plating solution in the cell results in high-speed, high quality wire plating. The invention particularly applies to the plating of nickel onto steel wire at current densities of up to 14,500 amps per square foot.

16 Claims, 4 Drawing Sheets

HIGH CURRENT DENSITY CONTINUOUS WIRE PLATING CELL

CROSS-REFERENCES TO RELATED APPLICATIONS

Information pertinent to this application is described and claimed in now U.S. Pat. No. 4,990,226, issued Feb. 5, 1991, filed concurrently with this application and assigned to the assignee of the instant application.

TECHNICAL FIELD

The invention relates to the art of electroplating and particularly to high-speed, high current density electroplating of wire.

BACKGROUND ART

High current density wire plating cells are known. See, e.g., U.S. Pat. Nos. 3,994,786, 3,894,924 and 3,549,507. The prior art devices disclosed therein provide current densities of up to 12,000 amps per square foot (ASF) and transverse flow of plating solution across the wire to reduce the depletion layer. However, only relatively slow plating speeds are achieved because the plating solutions used in these devices do not supply enough metal ions to the wire substrate to provide uniform plating. This condition results in relatively long and expensive plating processes, as well as nonuniform plating.

SUMMARY OF THE INVENTION

It is, therefore, an object of the invention to obviate the disadvantages of the prior art.

It is another object of the invention to enhance plating cells.

It is another object of the invention to provide superior plating performance in a relatively small plating chamber.

It is another object of the invention to increase the deposition rate of metal onto wire by providing a means of achieving higher current densities than are known in the art.

It is another object of the invention to provide a means for supplying highly concentrated plating solution to the plating cell at a high velocity and a substantial pressure.

It is another object of the invention to provide an improved method of plating nickel on steel wire.

These objects are accomplished, in one aspect of the invention, by a plating cell for the electroplating of wire. This plating cell comprises an enclosed electrically insulative housing with an inlet opening at the top for forced introduction of plating solution and an outlet opening at the bottom for exit of the solution. The wire to be plated moves through a passageway defined by a plurality of consumable anode structures contained within the plating cell which deposit metal ions on the wire as it passes through. The consumable anodes are connected to a supply of positive electrical potential. The structure of the anode allows plating solution to flow through it. The wire as it enters the plating cell contacts a metal roller aligned with the wire passageway. The roller is connected to a supply of negative electrical potential. Plating solution is pumped into the plating cell from an external pump to achieve a minimum of 50 lbs/in$^2$ pressure within the cell. The solution passes through the consumable anode structure and around the wire at such a velocity that electrodeposition of metal ions from the anode occurs at a rapid rate.

The spent plating solution may then be collected in a recovery tank below the plating cell. The solution may be recharged with metal ions by the addition of a metal salt. Alternatively, a separate plating cell may be used to provide excess metal ions in the solution by passing a current between an anode and a cathode of the same metal. Other metal salts may be added if the pH of the solution requires adjustment. The recharged solution is then reheated and pumped back through the plating cell.

BEST MODE FOR CARRYING OUT THE INVENTION

For a better understanding of the present invention, together with other and further objects, advantages and capabilities thereof, reference is made to the following disclosure, drawings and appended claims.

Figure 1:
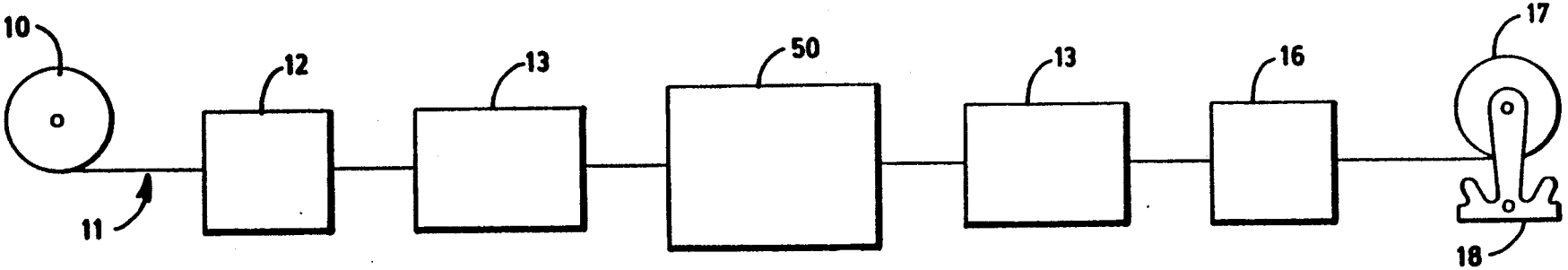
FIG. 1 is a schematic representation of a wire plating system.

Referring now to FIG. 1 there is shown a plating system wherein wire 11, which can be steel, from take-off spool 10 first passes through an acid activator station 12 and a cold water rinse station 13. It then enters the bottom portion of the first chamber 54 of the plating cell 50 after first contacting a metal contact roller (cathode) 66 which imparts a negative charge to the wire. The wire 11 runs straight through a passageway 51 defined by the centers of the nickel anodes 56 residing in the anode containment unit 72 at the bottom portion of each chamber. The wire 11 exits the first chamber 54, contacts an intermediate metal contact roller **66*a* which boosts the negative charge on the wire 11, and enters the second chamber 54*a* of the plating cell, which may be identical in construction to the first chamber 54. A third metal contact roller 66*b* briefly engages the wire as it exits the second chamber 54*a* of the cell 50 and passes to a final cold water rinse station 13 and an air wipe/dry station 16. The plated wire 11*a* is collected on takeup spool 17 driven by takeup drive means 18**. A preferred means for taking up the plated wire uses a constant tension take-up device.

Figure 2:
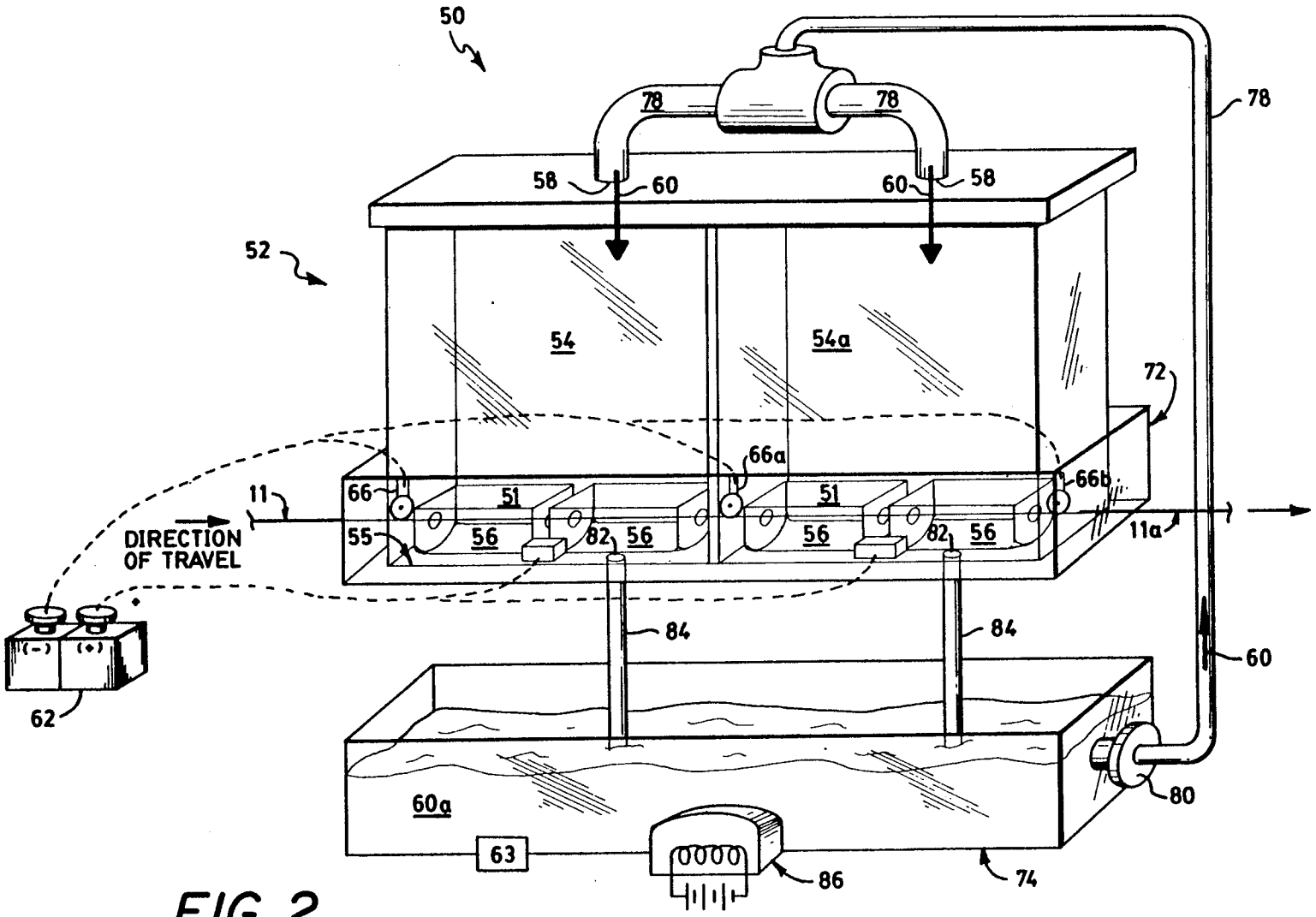
FIG. 2 is a side view with partial cutaway sections of a wire plating cell and solution recovery system.

The plating cell 50 as shown in FIG. 2 comprises an enclosed rectangular housing 52 made of an electrically insulative material such as, e.g., polypropylene, which is divided into two reservoir supply chambers 54 and **54*a*. Each chamber contains two metal anodes 56 in series within it, a supply port 58 for introduction of plating solution 60, and an outlet port for exit of the spent solution 60*a*. The anodes are connected to the positive terminal of power source 62. Between the two chambers 54 and 54*a* and on either side of them are metal contact rollers 66, 66*a* and 66*b*. The rollers are connected to the negative terminal of power source 62. As wire 11 enters the cell it contacts the first metal roller and becomes negatively charged with respect to the positively charged anodes 56. The base of the plating cell is an anode containment unit 72 which holds the two chambers 54 and 54***a*, the anodes 56 and the three metal contact rollers 66, 66*a*, and 66*b*. The entire cell thus occupies far less space than prior art devices and is preferably located on a bench with a solution recovery tank 74 below.

Each reservoir supply chamber 54 and 54*a* is preferably about 6¼ in (16 cm) long by 1 in (2.5 cm) wide by 12 in (30 cm) high, for a volume of about 75 cubic in (1200 cubic cm). Each chamber is completely enclosed except for a solution inlet opening 58 at the top and a solution outlet opening 82 at the bottom. Supply port 58 can be of any dimension but preferably is about one inch in diameter. Plating solution 60 is pumped by a magnetic drive pump 80 to the chambers 54 and 54*a* through the supply ports 58 by supply hoses 78. An important feature of the invention is that the solution flow rate into chambers 54 and 54*a* exceeds the outflow rate so that a minimum of 50 lbs/in$^2$ pressure is achieved within the chambers. Preferably, the pressure should be 100 lbs/in$^2$. Thus, the solution flows around the wire 11 and anodes 56 at a high velocity which provides continuous replenishment of metal ions to the solution to plate onto the wire 11. The spent solution 60*a* exits each chamber through exit port 82 and flows to recovery tank 74 below through exit hoses 84. The exit port 82 may be of any dimensions but should preferably be as small as is practical to maximize the fluid pressure within the chamber. The recovered solution is recharged by recharging means 63, reheated by heating means 86 and pumped back into the chambers 54 and 54*a* via supply hoses 78.

Figure 3:
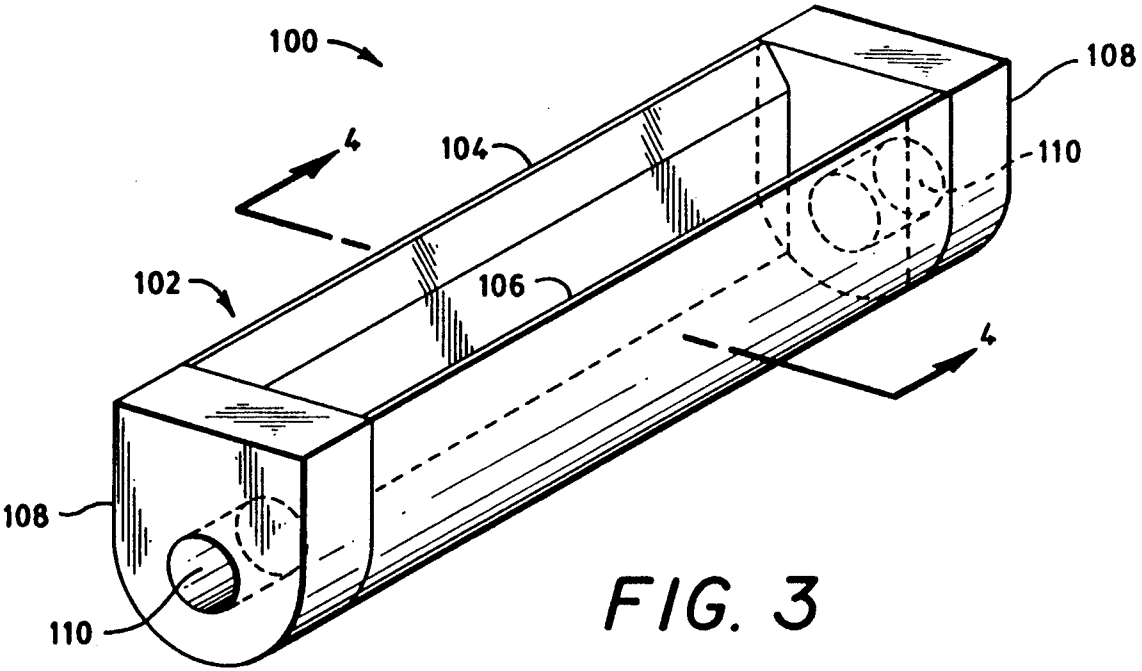
FIG. 3 is an isometric view of a preferred anode structure.
Figure 4:
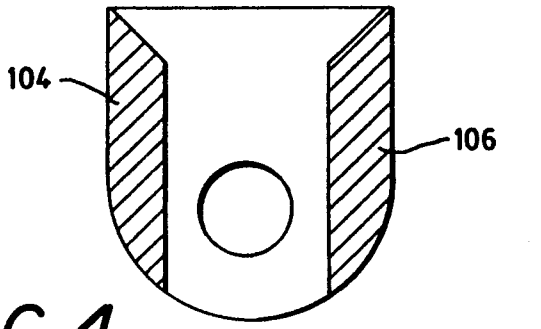
FIG. 4 is a sectional view taken along the line 4—4 of FIG. 3.
Figure 5:
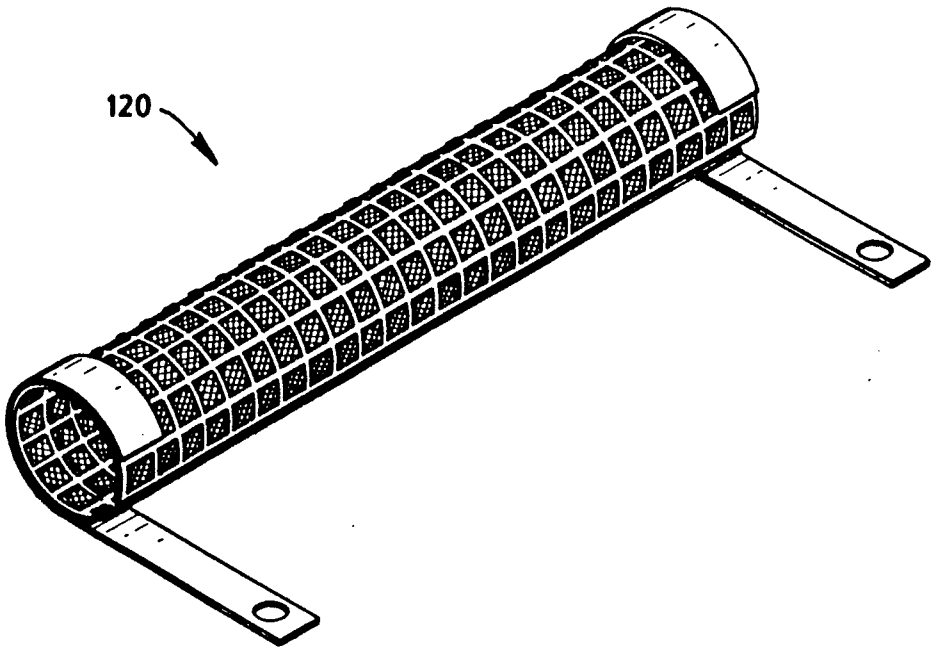
FIG. 5 is an isometric view of an alternative anode structure.

The consumable anode 56 is suitably shaped to allow the wire 11 to pass through the center of it as it passes through the cell 50. The preferred anode structure 100 (see FIGS. 3 and 4) is an elongated bar 102 having only side walls 104 and 106, joined at either end by end plates 108 having a hole 110 therethrough for passage of the wire 11. Alternatively, a perforated cylindrical anode structure 120 (see FIG. 5) may be used. Replacement anodes 56 are easily installed in the bottom of each chamber 54 and 54*a* to replenish those anodes consumed in the plating process. The chambers 54 and 54*a* may be separated by lifting each one up out of the anode containment unit 72.

The following non-limiting example is presented.

EXAMPLE I

The plating cell of the instant invention was charged with a highly concentrated nickel fluoborate bath (see the above-mentioned concurrently filed application, the teachings of which are hereby incorporated by reference). A one-foot length of 0.060 in (0.13 cm) diameter steel wire was immersed in the plating bath. The nickel fluoborate solution was pumped into the plating cell chambers at a rate of 53 gal/min (3.34 l/sec) using a March magnetic drive pump, model no. TE-7R-MD. At a current of 200 amps with a single plating cell, a current density of 12,700 ASF (13.7 amps/cm$^2$) was obtained. In just six seconds a smooth, adherent and ductile deposit of 0.00125" (0.00318 cm) was plated on the wire, for a plating rate of 10 feet per minute (5 cm/sec).

The wire speed as it passes through the cell may be varied to obtain a desired metal deposit thickness on the wire. Alternatively, the plating rate or plating thickness may be increased by placing one or more additional plating cells on the plating line. Also, a larger pump may be used to increase the solution flow rate into the reservoir supply chambers and thus increase the solution velocity at the plating zone.

While there has been shown and described what are at present considered the preferred embodiments of the invention, it will be obvious to those skilled in the art that various changes and modifications may be made therein without departing from the scope of the invention as defined by the appended claims.

What is claimed is:

1. A plating cell for the electroplating of wire, comprising:

a) an enclosed electrically insulative housing divided into two reservoir supply chambers each containing an inlet opening at the top for forced introduction of plating solution therein, an outlet opening at the bottom for exit of said plating solution therethrough, and a wire passageway therein through which said wire moves;

b) an anode containment unit which houses a plurality of consumable anode structures positioned at the bottom of each of said chambers, said anode structures at least partially surrounding said wire passageway and being connected to an external power source for supplying a positive electrical potential thereto and being aligned with said wire passageway such that said wire passes axially therethrough and said plating solution passes transversely therethrough;

c) electrical contact means positioned external to said chambers and aligned with said wire passageway for contacting said wire and imparting a negative electrical potential thereupon;

d) pumping means to inject said plating solution into each of said chambers to achieve a minimum pressure of 50 pounds per square inch therein, said plating solution passing transversely through said anode structures and around said wire; and e) recovery means for reheating and recycling said plating solution through said plating cell.

2. The plating cell of claim 1 wherein said consumable anode structure is a perforated nickel cylinder.

3. The consumable anode structure of claim 2 wherein said cylinder is about 1 in (2.5 cm) in diameter and about 6 in (15 cm) long.

4. The plating cell of claim 1 wherein said consumable anode structure is an elongated nickel bar having only side walls and joined at either end by end plates having a hole therethrough.

5. The consumable anode structure of claim 4 wherein said elongated bar is about ½ in (1.3 cm) wide by about 5 in (13 cm) long.

6. The plating cell of claim 1 wherein said electrical contact means comprises a metal roller which contacts said wire as it passes to and from said chambers, thereby charging said wire with a negative electrical potential.

7. The metal roller of claim 6 wherein said roller is made of copper.

8. The plating cell of claim 1 wherein said recovery means comprises a recovery tank disposed below said plating cell in which said solution is reheated before delivery by said pumping means back to said cell.

9. The plating cell of claim 1 wherein said recovery means further includes recharging means for replenishing a sufficient concentration of metal ions to said solution before it is recycled through said plating cell.

10. The plating cell of claim 1 wherein said reservoir supply chambers are about 1 in (2.5 cm) wide by 6¼ in (16 cm) long by 12 in (30 cm) high.

11. The plating cell of claim 1 wherein said housing and said anode containment unit are made of polypropylene.

12. The plating cell of claim 1 wherein said pumping means provides said plating solution to said cell at a rate of at least 53 gallons/min (3.34 l/sec).

13. The plating cell of claim 1 wherein said inlet opening in said reservoir supply chambers is about 1½ in (3.8 cm) in diameter.

14. The plating cell of claim 1 wherein said outlet opening in said reservoir supply chambers is about 1 in (2.5 cm) in diameter.

15. A plating cell for the electroplating of steel wire, comprising:

a) an enclosed electrically insulative housing divided into two reservoir supply chambers each containing an inlet opening at the top for forced introduction of plating solution therein, an outlet opening at the bottom for exit of said plating solution therethrough, and a wire passageway therein through which said steel wire moves;

b) an anode containment unit which houses a plurality of consumable anode structures positioned at the bottom of each of said chambers, said anode structures at least partially surrounding said wire passageway and being connected to an external power source for supplying a positive electrical potential thereto and being aligned with said wire passageway such that said steel wire passes axially therethrough and said plating solution passes transversely therethrough;

c) electrical contact means positioned external to said chambers and aligned with said wire passageway for contacting said steel wire and imparting a negative electrical potential thereupon;

d) pumping means to inject said plating solution into each of said chambers to achieve a minimum pressure of 50 pounds per square inch therein, said plating solution passing transversely through said anode structures and around said steel wire; and e) recovery means for reheating and recycling said plating solution through said plating cell.

16. A plating cell for the elecroplating of steel wire, comprising:

a) an enclosed electrically insulative housing divided into two reservoir supply chambers each containing an inlet opening at the top for forced introduction of plating solution therein, said plating solution being a highly concentrated nickel fluoborate bath consisting essentially of nickel fluoborate and boric acid, said plating solution being pumped through said cell at a current density of at least 200 amps per square foot, an outlet opening at the bottom for exit of said plating solution therethrough, and a wire passageway therein through which said steel wire moves;

b) an anode containment unit which houses a plurality of consumable anode structures positioned at the bottom of each of said chambers, said anode structures at least partially surrounding said wire passageway and being connected to an external power source for supplying a positive electrical potential thereto and being aligned with said wire passageway such that said steel wire passes axially therethrough and said plating solution passes transversely therethrough;

c) electrical contact means positioned external to said chambers and aligned with said wire passageway for contacting said steel wire and imparting a negative electrical potential thereupon;

d) pumping means to inject said plating solution into each of said chambers to achieve a minimum pressure of 50 pounds per square inch therein, said plating solution passing transversely through said anode structures and around said steel wire; and e) recovery means for reheating and recycling said plating solution through said plating cell.

* * * * *